US009528519B2

(12) United States Patent
Sausner et al.

(10) Patent No.: US 9,528,519 B2
(45) Date of Patent: Dec. 27, 2016

(54) PRESSURE CONTROL BY PHASE CURRENT AND INITIAL ADJUSTMENT AT CAR LINE

(71) Applicant: Continental Automotive Systems, Inc., Auburn Hills, MI (US)

(72) Inventors: Andreas Sausner, Eschborn (DE); Marc Völker, Magdeburg (DE)

(73) Assignee: Continental Automotive Systems, Inc., Auburn Hills, MI (US)

( * ) Notice: Subject to any disclaimer, the term of this patent is extended or adjusted under 35 U.S.C. 154(b) by 283 days.

(21) Appl. No.: 14/045,272

(22) Filed: Oct. 3, 2013

(65) Prior Publication Data

US 2014/0105758 A1 Apr. 17, 2014

Related U.S. Application Data

(60) Provisional application No. 61/713,183, filed on Oct. 12, 2012.

(51) Int. Cl.
*F04D 13/06* (2006.01)
*F04C 14/24* (2006.01)
(Continued)

(52) U.S. Cl.
CPC ..... *F04D 13/0686* (2013.01); *F02D 41/221* (2013.01); *F02D 41/2438* (2013.01);
(Continued)

(58) Field of Classification Search
CPC F02D 41/221; F02D 41/2438; F02D 41/2464; F02D 41/3082; F02D 41/3845; F02D 13/0686; F02D 2041/2027; F02D 41/266; F04C 14/24
(Continued)

(56) References Cited

U.S. PATENT DOCUMENTS 5,505,180 A 4/1996 Otterman
5,715,797 A * 2/1998 Minagawa ..... F02D 41/3082 123/478
(Continued)

FOREIGN PATENT DOCUMENTS

DE 19625902 A1 3/1997
DE 102005023189 A1 11/2006
(Continued)

OTHER PUBLICATIONS

KR 10-2012-0062108, English Translation.*
(Continued)

*Primary Examiner* — Dominick L Plakkoottam

(57) ABSTRACT

A closed loop control system for a fuel pump based on characteristics of speed, pressure, and current. The pressure generated by the pump system is increased at the point in time when the pump system is working against a dead head system (i.e., coasting) to a level that a calibration valve is opened to a determined working point. By measuring the characteristic phase current as a function of the speed, the characteristic is able to be compared, with the pre-calibrated value of the hardware to perform an error compensation algorithm. The error compensation is overlaid with the standard pressure characteristic as a function of speed and phase current, and uses the pre-calibrated opening pressure value (i.e., the inflection point) of the calibration valve and/or in addition the change of the speed to the initial (first calibration), or to a sliding average therefrom.

4 Claims, 3 Drawing Sheets

(51) Int. Cl.

| | |
|---|---|
| ***F02D 41/22*** | (2006.01) |
| ***F02D 41/24*** | (2006.01) |
| ***F02D 41/30*** | (2006.01) |
| ***F02D 41/38*** | (2006.01) |
| *F02D 41/20* | (2006.01) |

(52) U.S. Cl.
CPC ..... *F02D 41/2464* (2013.01); *F02D 41/3082* (2013.01); *F02D 41/3845* (2013.01); *F04C 14/24* (2013.01); *F02D 2041/2027* (2013.01)

(58) Field of Classification Search
USPC ..... 123/497
See application file for complete search history.

(56) References Cited

U.S. PATENT DOCUMENTS

| | | | | |
|---|---|---|---|---|
| 6,279,541 | B1 * | 8/2001 | Doane | F02D 41/3082 123/497 |
| 7,784,446 | B2 | 8/2010 | Rumpf | |
| 8,707,932 | B1 * | 4/2014 | Marin | F02D 41/3082 123/479 |
| 2003/0136376 | A1 * | 7/2003 | Tachibana | F01L 1/344 123/396 |
| 2013/0166482 | A1 | 6/2013 | Veit | |

FOREIGN PATENT DOCUMENTS

| | | | |
|---|---|---|---|
| DE | 102010030872 | A1 | 1/2012 |
| EP | 1637723 | A1 | 3/2006 |
| JP | 2009-185915 | A | 8/2009 |
| KR | 1020120062108 | A | 6/2014 |
| WO | 2008067622 | A2 | 6/2008 |

OTHER PUBLICATIONS

JP 2009-185915, English Translation.*
International Search Report and the Written Opinion of the International Searching Authority dated Dec. 13, 2013. PCT/US2013/064486.

* cited by examiner

PRESSURE CONTROL BY PHASE CURRENT AND INITIAL ADJUSTMENT AT CAR LINE

CROSS-REFERENCE TO RELATED APPLICATIONS

This application claims the benefit of U.S. Provisional Application No. 61/713,183 filed Oct. 12, 2012. The disclosure of the above application is incorporated herein by reference.

FIELD OF THE INVENTION

The invention relates generally to a closed loop control system for a fuel pump which also includes calibration functionality.

BACKGROUND OF THE INVENTION

Fuel pumps are commonly used to transfer fuel to an injection system for an engine. It is common for a fuel pump to be driven by a type of motor, such as an electric motor. The operation of the fuel pump and motor are typically controlled by some type of closed-loop feedback system, where pressure is monitored, and the speed of the pump is adjusted based on a comparison of the measured pressure to the desired pressure. These types of closed-loop feedback control systems require a pressure sensor to monitor the pressure. The type of pressure sensor required for a closed-loop feedback system is costly and adds components to the system.

Other attempts have been made to control a fuel pump and motor by using an open-loop control system. An open-loop control system includes a control map which includes various speeds and flow rates which correspond to each speed, the pump operates at a particular speed to generate the correct flow. An open-loop system for a fuel pump does not provide a measurement of pressure that is used for comparison to a desired pressure. There are several speeds used to provide different flow rates, and the operation of the pump is changed to correspond to a desired flow rate. Known mapped control systems (such as open-loop control systems) exhibit a high uncertainty with regard to the real pressure and may not always take advantage of full potential energy savings, since under certain conditions high fitting pressure adversely affects the energy balance.

Accordingly, there exists a need for a closed-loop control system for a fuel pump which does not require a pressure sensor, and is more accurate than an open-loop control system.

SUMMARY OF THE INVENTION

It is an object of the present invention to provide a closed loop control system for a fuel pump based on characteristics of speed, pressure, and current.

The pressure generated by the pump system of the present invention is increased at the point in time when the pump system is working against a dead head system (i.e., coasting) to a level that the calibration valve is opened to a determined working point. By measuring the characteristic phase current as a function of the speed, the characteristic is able to be compared at the inflection point, with the pre-calibrated value of the hardware to perform an error compensation algorithm.

The error compensation is overlaid with the standard pressure characteristic (as a function of speed and phase current) resulting in an effective pressure which is more precise.

The error compensation uses the pre-calibrated opening pressure value (inflection point) of the calibration valve and/or in addition to the change of the speed (influenced in the short term by changes in viscosity, media, and in the long-term by wear) to the initial (first calibration) or to a sliding average therefrom.

The pump system of the present invention is more precise than a preconfigured map control (which has a total failure of the summation of component tolerances), and does not require a pressure sensor. The approach of the present invention also allows for the prediction of long term deviations caused by wear, as well as actual conditions (short term) caused by changes of fluid properties.

In one embodiment, the present invention is a pump system having a motor, a pump for generating a pumping action to pump fluid, where the pump is connected to and driven by the motor. The pump system also has an inlet conduit in fluid communication with the motor, allowing fluid to pass into the pump, and an outlet conduit in fluid communication with the pump, such that the fluid flowing into the outlet conduit is pressurized by the pump. A secondary conduit is in fluid communication with the outlet conduit such that a portion of the fluid pressurized by the pump flows into the secondary conduit. A calibration valve is in fluid communication with the secondary conduit, and the calibration valve changes between an open position and a closed position to limit the maximum pressure in the secondary conduit and outlet conduit. The pressure of the fluid in the outlet conduit and the secondary conduit is based on the position of the calibration valve and the current applied to the motor, such that a substantially constant pressure is maintained.

In one embodiment, the motor is a three-phase motor, the current applied to the motor is phase current, and the speed of the motor is based on the phase current applied to the motor. As the phase current applied to the three-phase motor changes, the speed of the motor changes, and the output of the pump changes, while maintaining substantially constant pressure.

The pump system also has closed loop functionality, where the pump operates at a plurality of speeds, and the current is measured at each of the speeds. A first rate of change is based on a first difference in measured current between two of the commanded speeds, a second rate of change is based on a second difference in measured current between two more commanded speeds, and the first rate of change is greater than the second rate of change. The first rate of change occurs when the valve is closed, and the second rate of change occurs when the valve is open.

The pump system also includes a calibration function. A third rate of change is based on a third difference in measured current between another two of the commanded speeds, and a fourth rate of change is based on a fourth difference in measured current between yet another two of the commanded speeds. The third rate of change is greater than the fourth rate of change, and the third rate of change occurs when the valve is open, and the fourth rate of change occurs when the valve is closed.

The pump may be different types of pumps, such as a gerotor pump, an impeller pump, or the like.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
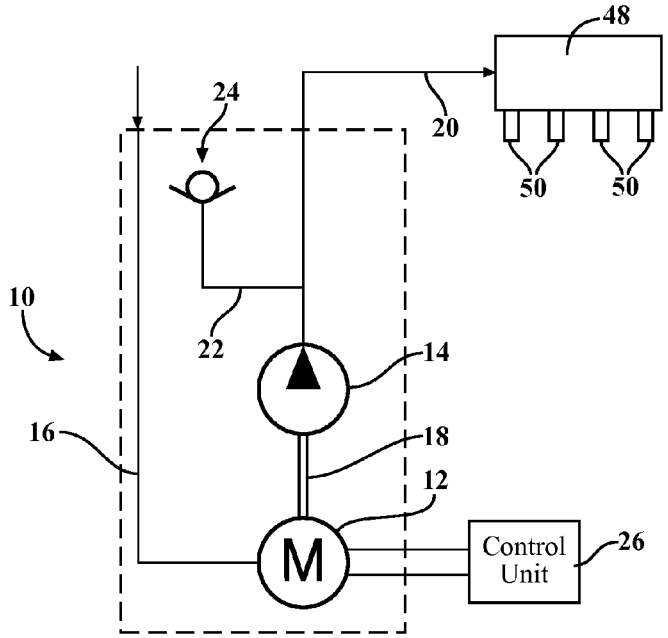
FIG. 1 is diagram of a pump system, according to embodiments of the present invention.
Figure 2:
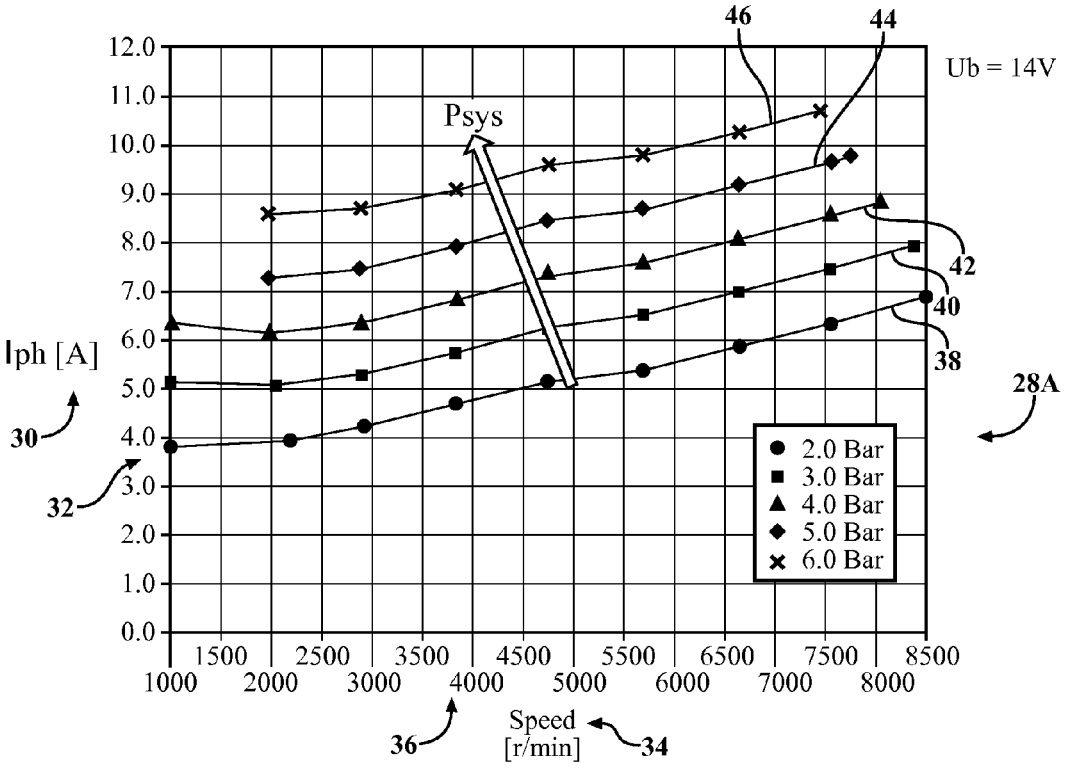
FIG. 2 is a first chart having speed and the corresponding phase current for a pump system according to the present invention.
Figure 3:
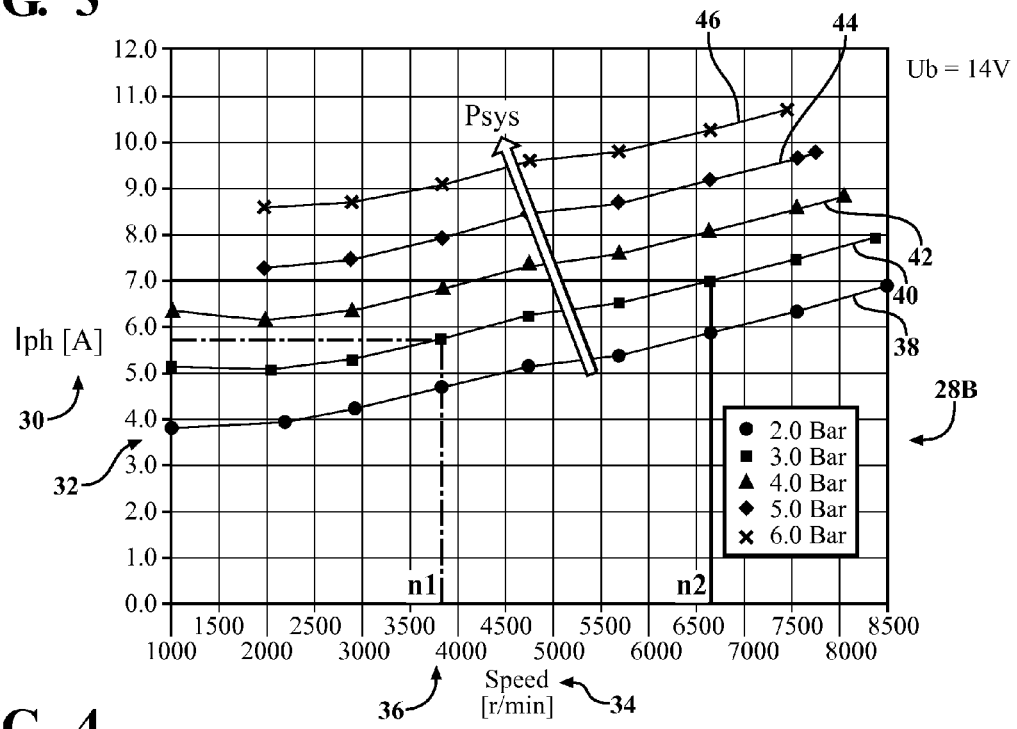
FIG. 3 is a second chart having speed and the corresponding phase current for a pump system according to the present invention.
Figure 4:
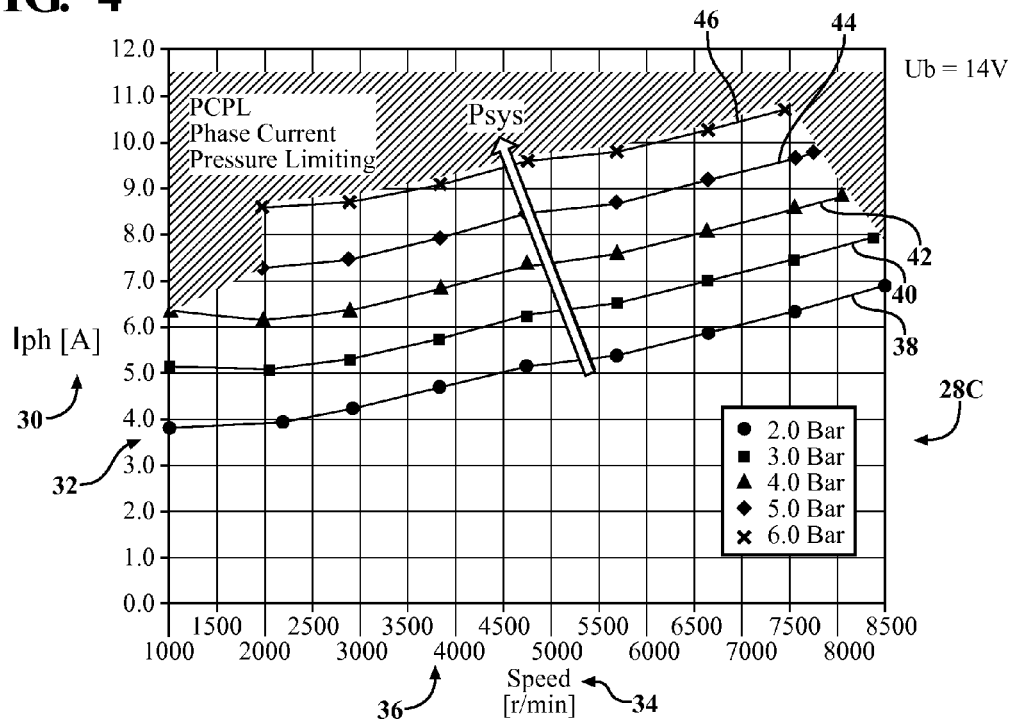
FIG. 4 is a third chart having speed and the corresponding phase current for a pump system according to the present invention.

The following description of the preferred embodiment(s) is merely exemplary in nature and is in no way intended to limit the invention, its application, or uses.

A diagram of a pump system according to the present invention is shown at 10. The pump system 10 includes a motor 12 and a device 14 for generating a pumping action, such as, but not limited to, a gerotor pump, an impeller pump, or any other mechanism suitable for creating a pumping action. The motor 12 is in fluid communication with an inlet conduit 16. The motor 12 is also connected to the device 14 through a mechanical connection 18. The device 14 is in fluid communication with an outlet conduit 20, and the outlet conduit 20 is in fluid communication with a secondary conduit 22. In fluid communication with the secondary conduit 22 is an internal calibration valve, shown generally at 24. The pump system 10 is controlled by a control unit 26. The input signal into the control unit 26 determines the nominal pressure, by using the phase current and/or speed of the pump system 10 (and more specifically, the motor 12) in a way such that the pressure requirement is met.

In operation, fuel flows through the inlet conduit 16 and through the motor 12, a pumping action is created by the motor 12 driving the device 14, which draws the fuel from the inlet conduit 16, through the motor 12, the device 14, and out of the outlet conduit 20. A portion of the fuel also flows into the secondary conduit 22, and the fluid in the outlet conduit 20 and the secondary conduit 22 is allowed to reach a maximum value as determined by the calibration valve 24. The calibration valve 24 is capable of changing between an open position and a closed position. The calibration valve 24 remains in a closed position until a predetermined pressure level is met in the secondary conduit 22 and the outlet conduit 20.

In this embodiment, the motor is a three-phase motor 12 having three windings. The speed of the motor 12 is a function of current, more particularly phase current. The engine requires different amounts of fuel based on the different speeds at which the engine operates. The phase current of the motor 12 is proportional with the pressure generated by the device 14 for one dedicated engine speed. As the pressure in the outlet conduit 20 and the secondary conduit 22 generated by the motor 12 remains constant, the current of the motor 12, speed of the motor 12, and the flow rate of the pump 14 change accordingly. By knowing at least the phase current of the motor 12, information regarding the pressure may be obtained, and the pressure readings are more accurate by compensation of the slope over the speed of the motor 12.

Referring to FIGS. 2-6, various charts are shown representing the correlation between the phase current and speed of the motor 12, and the corresponding pressure generated by the pump 14. Referring to the first chart 28A in FIG. 2, the second chart 28B in FIG. 3, and the third chart 28C shown in FIG. 4, the current (in Amps), indicated generally at 30, is located along a Y-axis, shown generally at 32, and the speed (in revolutions per minute (RPM)), indicated generally at 34, is located along an X-axis, shown generally at 36. There are also several curves plotted on the charts 28A,28B,28C with each curve representing a different pressure of the fuel flowing through the system 10.

A first curve 38 represents pressure at 2.0 Bar, a second curve 40 represents pressure at 3.0 Bar, a third curve 42 represents pressure at 4.0 Bar, a fourth curve 44 represents pressure at 5.0 Bar, and a fifth curve 46 represents pressure at 6.0 bar. In order to maintain a specific pressure level, the speed 34 and current 30 are changed, which varies the output flow rate of the pump 14. The fuel flows out of the outlet conduit 20 and to the other fuel system components, such as a fuel rail 48 having one or more injectors 50.

As can be seen when looking at the charts 28A,28B,28C, the first curve 38 represents pressure at 2.0 Bar, and as the phase current 30 is increased, the speed of the motor 12 is also increased. In order to maintain the desired pressure of 2.0 Bar, as the speed 34 and therefore the phase current 30 of the motor 12 is increased, a larger amount of fuel passes through the injectors 50, and therefore the flow rate is increased. Conversely, as the speed 34 and therefore the phase current 30 of the motor is decreased, the smaller amount of fuel passes through the injectors 50, and therefore the flow rate is decreased to maintain the desired pressure of 2.0 Bar. The flow rate is also changed as the phase current 30 and the speed 34 are changed, and a desired pressure is maintained as indicated by the other curves 40,42,44,46 in the charts 28A,28B,28C.

The phase current 30 is also known because the phase current 30 is measured; the speed 34 of the motor 12 is controlled, and the phase current 30 needed to obtain the desired speed 34 is measured, and therefore the speed 34 is of the motor 12 corresponds to the required phase current 30 input to the motor 12. Because the motor 12 is a three-phase motor, the motor 12 therefore has three coil pairs, and only one coil pair is needed to monitor the phase current 30.

When the pump system 10 is assembled, the system 10 is calibrated to function correctly using the speed 34 and measured phase current 30. Referring to the fourth chart 28D shown in FIG. 5 and the fifth chart 28E shown in FIG. 6, a pressure calibration curve 52 is generated using the current 30 and speed 34 of the motor 12, and the pump 14. The calibration valve 24 is designed to open when the pressure of the fluid in the secondary conduit 22 approaches a predetermined value, which in this embodiment is about 6.5 Bar. Once the pressure level of 6.5 Bar is reached, the system 10 is coasting to a level such that the valve 24 is opened to a predetermined working point.

Figure 5:
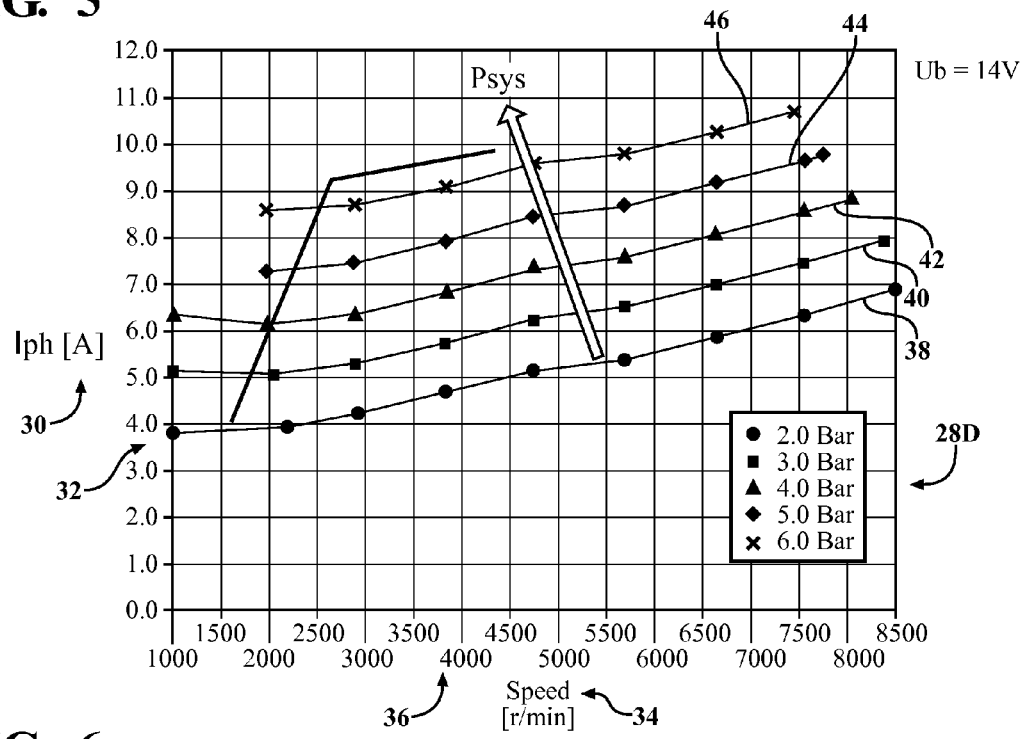
FIG. 5 is a fourth chart having speed and the corresponding phase current for a pump system according to the present invention.
Figure 6:
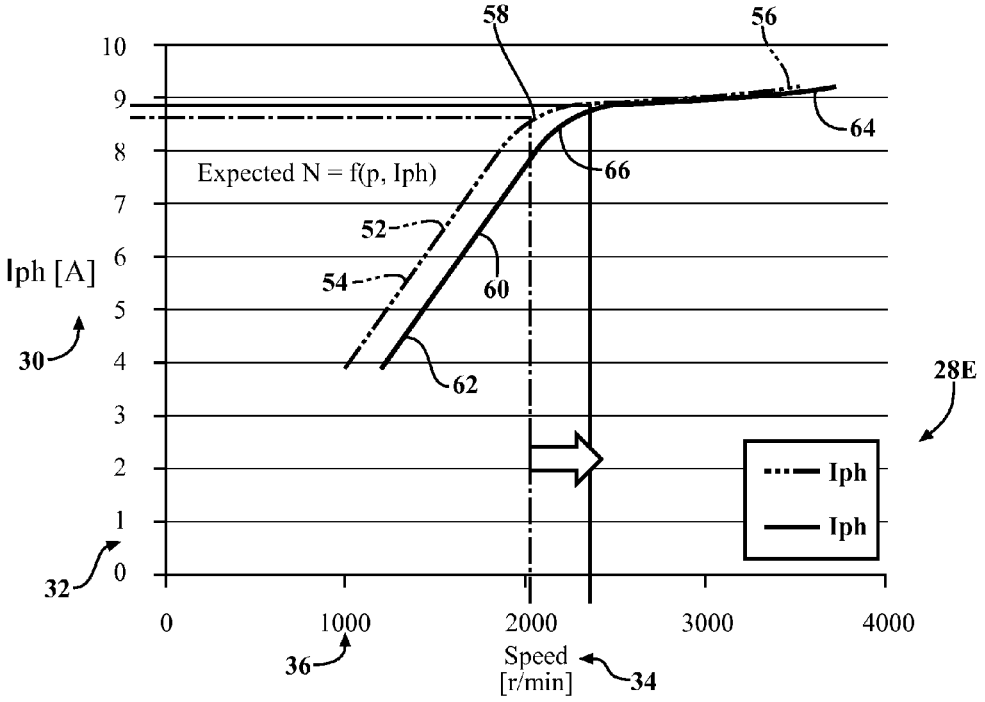
FIG. 6 is a fifth chart having speed and the corresponding phase current for a pump system according to the present invention.

As shown in FIGS. 5-6, the calibration curve 52 has two different slopes, a first portion 54 having a first slope, and a second portion 56 having a second slope. The first portion 54 of the curve 52 represents the operation of the motor 12 and pump 14 when the valve 24 is closed, and the second portion 56 of the curve 52 represents the operation of the motor 12 and pump 14 when the valve 24 is open. To generate the curve 52, the motor 12 is commanded to operate at various speeds, and the phase current 30 is then measured at each speed. There is no sensor used for detecting whether the valve 24 is open or closed.

In this embodiment, and as shown in FIG. 6, when the motor 12 is commanded to operate at a first speed, which in this embodiment is about 1100 rpm, the measured current 30 is about 4.0 Amperes, and when the motor 12 is operating at a second speed, about 1500 rpm, the current 30 is about 6.1 Amperes. Furthermore, when the motor 12 is operating at a third speed, about 2500 rpm, the current 30 is about 8.9 Amperes, and when the motor 12 is operating at a fourth speed, about 3000 rpm, the current 30 is about 9.1 Amperes. Along the first portion 54 of the curve 52, the current 30 increases about 2.1 Amperes as the speed 34 increases from the first speed of 1100 rpm to the second speed of 1500 rpm, a difference of 400 rpm (a rate of change of about 0.525 Amperes for every increase in 100 rpm). Along the second portion 56 of the curve 52, the current 30 increases about 0.2 Amperes as the speed 34 increases from the third speed of 2500 rpm to the fourth speed of 3000 rpm, a difference of 500 rpm (a rate of change of about 0.04 Amperes for every increase in 100 rpm).

To increase the speed 400 rpm along the first portion 54 of the curve 52, the current increased 2.1 Amperes, and to increase the speed 500 rpm along the second portion 56 of the curve 52, the current 30 increased only 0.2 Amperes. The current 30 increases (as the speed 34 is increased) at a different rate along the first portion 54 of the curve 52 compared to the second portion 56 of the curve 52. Therefore, the first portion 54 of the curve 52 has a first rate of change (of current 30 versus speed 34) of about 0.525 Amperes for every increase in 100 rpm, and the second portion 56 of the curve 52 has a second rate of change (of current 30 versus speed 34) of about 0.04 Amperes for every increase in 100 rpm.

Furthermore, as the speed 34 is increased, the pressure in the system 10 is increased. However, the increase in pressure as the speed 34 is increased is limited by the calibration valve 24. Once the pressure in the system 10 reaches 6.5 Bar, the valve 24 opens, maintaining the pressure at 6.5 Bar, even as the speed 34 continues to increase; the valve 24 opens further to allow for an increase in flow and a constant pressure to be maintained. The change in current 30 required to increase the speed 34 of the motor 12 when the valve 24 is closed is greater than the change in current 30 required to increase the speed 34 of the motor 12 when the valve 24 is opened. Therefore, the increase in unit of current 30 per increase in unit of speed 34 is greater along the first portion 54 of the curve 52 (i.e., the first rate of change) compared to the second portion 56 of the curve 52 (i.e., the second rate of change).

The area of the calibration curve 52 where the first portion 54 ends and the second portion 56 begins is an inflection point 58. The inflection point 58 also represents the point during operation when the calibration valve 24 opens. After the calibration valve 24 opens, less current 30 is required to increase the speed 34, because the valve 24 opens further to allow for an increase in flow, while maintaining the maximum allowed pressure, which as previously mentioned in this example is 6.5 Bar. Along the second portion 56 of the curve 52, if the speed 34 is increased, the flow is increased, and the current 30 increases as well.

In addition to having closed loop functionality, the system 10 also includes tolerance compensation capability, or a calibration function, as well. Referring to FIG. 6, to compensate for the tolerance in the pump system 10, the calibration curve 52 is generated when the motor 12 and pump 14 are new. During the life of the system 10, a second curve, or operation curve 60 is generated also having a first portion 62, a second portion 64, and an inflection point 66. The second curve 60 is created by commanding the motor 12 to operate at a specific speed 34, and the phase current 30 is then measured as the motor 12 operates at each speed 34.

To obtain a measurement of current 30 of about 4.0 Amperes along the operation curve 60, the motor 12 is commanded to operate at a fifth speed, which in this embodiment is about 1200 rpm, and to obtain a measurement of current 30 of about 6.1 Amperes, the motor 12 is commanded to operate at a sixth speed of about 1600 rpm. The first portion 62 of the curve 60 has a third rate of change (of current 30 versus speed 34), of about 0.525 Amperes for every increase in 100 rpm, which is similar to the first rate of change. However, while the first rate of change and third rate of change are substantially similar, the measurements of current 30 occur at different speeds, which is a result of a change in the operation of the system 10 over time due to wear, changes in fluid viscosity, or other factors.

To obtain a measurement of current 30 of about 8.9 Amperes along the operation curve 60, the motor 12 is commanded to operate at a seventh speed, about 2600 rpm, and to obtain a measurement of current 30 of about 9.1 Amperes, the motor 12 is commanded to operate at an eighth speed, about 3100 rpm. The second portion 64 of the curve 60 has a fourth rate of change (of current 30 versus speed 34) of about 0.04 Amperes for every increase in 100 rpm, which is similar to the second rate of change. However, while the second rate of change and fourth rate of change are substantially similar, the measurements of current occur at different speeds, which is a result of a change in the operation of the system 10 over time due to wear, changes in fluid viscosity, or other factors.

It is shown in FIG. 6 that the calibration curve 52 is different from the operation curve 60. The calibration curve 52 represents the operation of the system 10 when the system 10 is new, and the operation curve 60 represents the operation of the system 10 after a period of time has passed, and the various components of the system 10 have undergone some level of wear, or other factors may have occurred which affect the operation of the system 10. The operation curve 60 provides an indication of how the operation of the system 10 has changed over time. A new operation curve 60 may be generated based on specific time intervals, such as daily, monthly, or yearly, or may be generated under specific conditions, such as upon vehicle start up, when there is a significant temperature change, or the like. The operation curve 60 provides a different operation functionality to the pump system 10. This allows for the system 10 to not only provide closed loop functionality, but also provides for compensation for tolerances and variations in the function of the system 10 over time.

In alternate embodiments, it is also possible to have the pump system 10 operate without the use of the calibration valve 24. The phase current and/or speed of the motor 12 is used such that the pressure requirement is met.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method for providing phase current pressure control of a pump, comprising the steps of: providing a motor; providing a device for generating a pumping action to pump a fluid, the device connected to the motor; providing a valve in fluid communication with the device; and providing current input to the motor; opening the valve a predetermined amount; measuring the speed of the motor as a function of the current input to the motor when the valve is open to determine at least one rate of change of current based on a change in commanded speed; comparing the at least one rate of change in current to an expected rate of change in current to achieve a calibration pressure; changing the operation of the motor based on the calibration pressure; commanding the motor to operate at a plurality of speeds; measuring the current at each of the plurality of speeds; providing a first rate of change based on a first difference in measured current between two of the plurality of speeds; providing a second rate of change based on a second difference in measured current between another two of the plurality of speeds; providing the first rate of change to occur when the valve is closed, and providing the second rate of change to occur when the valve is open such that the second rate of change is less than the first rate of change.

2. The method of claim 1, further comprising the steps of calibrating the valve to open when the device pumps the fluid at a predetermined pressure.

3. The method of claim 1, further comprising the steps of:

providing a third rate of change based on a third difference in measured current between another two of the plurality of speeds;

providing a fourth rate of change based on a fourth difference in measured current between another two of the plurality of speeds; and providing the third rate of change to occur when the valve is closed, and the fourth rate of change to occur when the valve is open such that the fourth rate of change is less than the third rate of change.

4. The method of claim 3, further comprising the steps of:

comparing the first rate of change to the third rate of change to calibrate the operation of the device when the valve is closed; and comparing the second rate of change to the fourth rate of change to calibrate the operation of the device when the valve is open.

* * * * *